US007525074B2

(12) United States Patent
Bostick et al.

(10) Patent No.: US 7,525,074 B2
(45) Date of Patent: Apr. 28, 2009

(54) METHOD AND APPARATUS FOR DETECTING METAL PLACED WITHIN A MICROWAVE OVEN

(75) Inventors: James Edward Bostick, Cedar Park, TX (US); Randolph Michael Forlenza, Austin, TX (US); John Paul Kaemmerer, Pflugerville, TX (US); Raghuraman Kalyanaraman, Austin, TX (US); Courtney Joseph Spooner, Hutto, TX (US)

(73) Assignee: International Business Machines Corporation, Armonk, NY (US)

( * ) Notice: Subject to any disclaimer, the term of this patent is extended or adjusted under 35 U.S.C. 154(b) by 318 days.

(21) Appl. No.: 11/421,244

(22) Filed: May 31, 2006

(65) Prior Publication Data

US 2007/0278220 A1 Dec. 6, 2007

(51) Int. Cl.
*H05B 6/68* (2006.01)

(52) U.S. Cl. ..... 219/702; 219/704; 219/736; 340/541; 340/545.1

(58) Field of Classification Search ..... 219/702–720, 219/736–739, 626; 340/541, 545.1; 34/259–261
See application file for complete search history.

(56) References Cited

U.S. PATENT DOCUMENTS

| | | | | |
|---|---|---|---|---|
| 4,166,973 | A | 9/1979 | Lilly, Jr. et al. | |
| 4,343,990 | A * | 8/1982 | Ueda | 219/492 |
| 5,424,515 | A * | 6/1995 | Gentile | 219/702 |
| 5,698,125 | A | 12/1997 | Kwon | |
| 5,961,872 | A | 10/1999 | Simon et al. | |
| 2003/0029327 | A1 | 2/2003 | Zhu | |

FOREIGN PATENT DOCUMENTS

| | | | | |
|---|---|---|---|---|
| JP | 1-190398 | * | 7/1989 | |
| JP | 4-95383 | * | 3/1992 | 219/626 |

* cited by examiner

*Primary Examiner*—Philip H Leung
(74) *Attorney, Agent, or Firm*—Yee & Associates, P.C.; David A. Mims, Jr.

(57) ABSTRACT

A method, apparatus, and computer usable program code for detecting a presence of metal objects placed in a microwave cooking unit. A metal detection unit is activated to scan for the presence of a metal object placed into a cooking area of the microwave cooking unit. In response to receiving an indicator of the presence of a metal object from the metal detection unit, the process generates an alert indicating the presence of the metal object.

12 Claims, 3 Drawing Sheets

METHOD AND APPARATUS FOR DETECTING METAL PLACED WITHIN A MICROWAVE OVEN

BACKGROUND OF THE INVENTION

1. Field of the Invention

The present invention is related generally to an improved data processing system, and in particular to a method and apparatus for controlling a microwave cooking unit. Still more particularly, the present invention is directed to a computer implemented method, computer usable program code, and an apparatus for dynamically detecting metal objects placed in a microwave cooking area.

2. Description of the Related Art

A microwave cooking unit, such as a microwave oven, is a device employing microwave radiation to cook, heat, melt, or defrost food items. For example, one of the most popular food items cooked in a microwave oven is microwave popcorn. Microwave ovens generally utilize a magnetron, which is a device for generating microwaves. Microwave ovens are popular because they are capable of cooking food in a short amount of time by utilizing microwaves rather than cooking by heat convection as in standard gas or electric ovens.

Microwaves are radio waves within a frequency range that is absorbed by water, fats, and sugars but not by most plastics, glass, or ceramics. For example, when a ceramic bowl filled with soup is heated in a microwave, the microwaves are absorbed by the water and fat molecules, but not by the ceramic container. The microwaves excite the water and fat molecules to generate heat relatively evenly throughout the soup, although the temperature within the microwave oven itself remains at approximately room temperature. Thus, it is sometimes said that microwave ovens cook food from the inside out.

Unlike most plastics, glass, or ceramics, however, most metals reflect microwaves. When a metal object is left inside a microwave oven cooking chamber during operation of the microwave oven, the metal object can reflect the microwaves back into the magnetron, where arcing can occur. This arcing can damage the magnetron.

In addition, the presence of metal objects inside a microwave oven cooking chamber can result in the production of sparks and/or create a potential for a fire or explosion. For example, metal utensils, a metal staple in a paper or cardboard takeout bag or container, aluminum foil, tin foil, or metal plates can cause the formation of sparks.

In addition, the presence of a metal object can cause a potential for a fire and/or an explosion to occur. For example, paper takeout bags containing food item are sometimes stapled shut and cardboard takeout boxes sometimes include a metal handle. If such a takeout container is placed inside a microwave for heating without removing the staples and/or metal handle, the metal can form sparks that cause the paper or cardboard to catch fire.

Mistakenly placing a metal object inside a microwave oven can cause sparking, fires, explosions, and/or damage to the magnetron. In cases where the magnetron is damaged, the microwave oven heating element will not function. In such a case, the microwave oven is generally rendered useless for the purposes of microwave cooking.

SUMMARY OF THE INVENTION

The aspects of the illustrative embodiments provide a computer implemented method, apparatus, and computer usable program code to detect a presence of metal objects placed in a microwave cooking unit. A metal detection unit is activated to scan for the presence of a metal object placed into a cooking area of the microwave cooking unit. In response to receiving an indicator of the presence of a metal object from the metal detection unit, the process generates an alert indicating the presence of the metal object.

BRIEF DESCRIPTION OF THE DRAWING

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

A microwave cooking unit is a device employing microwave radiation to cook, heat, melt, or defrost food items. As used herein, a "microwave cooking unit" includes a microwave oven, a convection microwave oven, or any other device for utilizing microwaves to cook, heat, melt, or defrost one or more food items. Microwave ovens are popular because they are capable of cooking food in a short amount of time by utilizing microwaves rather than cooking by heat convection as in standard gas or electric ovens. As used herein, a "food item" is defined to include water, as well as any solid, semi-solid, or liquid foodstuffs. For example, food items include, but are not limited to, burritos, popcorn, pancakes, pizza, pasta, soup, water, milk, coffee, chocolate, butter, fat, protein, carbohydrates, and any other comestibles.

Microwaves are absorbed by water, fats, and sugars but not by most plastics, glass, or ceramics. However, microwaves are reflected by most metal objects. Thus, mistakenly placing a metal object inside a microwave oven can cause sparking, fires, explosions, and/or damage to the magnetron. In cases where the magnetron is damaged, the microwave oven is no longer capable of operating to cook and/or heat food items.

The aspects of the illustrative embodiments recognize the need for a protection mechanism to prevent operation of a microwave cooking function when a metal object has been placed inside a cooking chamber of a microwave cooking unit. Thus, the illustrative embodiments are directed to a method, computer usable program code, and an apparatus for dynamically detecting a presence of one or more metal objects placed in a cooking chamber of a microwave cooking unit and providing a warning to a user as to the presence of the one or more metal objects. A metal detection unit is provided in the face of the microwave cooking unit. The metal detection unit is localized and directional. The metal detection unit is activated to scan for the presence of a metal object when a door of the microwave cooking unit is opened and one or more objects are placed in a cooking area of the microwave cooking unit. If a metal object is detected passing through a scan zone of the metal detection unit, the process receives an indicator of the presence of the metal object. A notification or warning of the presence of the metal object is provided to a user of the microwave cooking unit.

Figure 1:
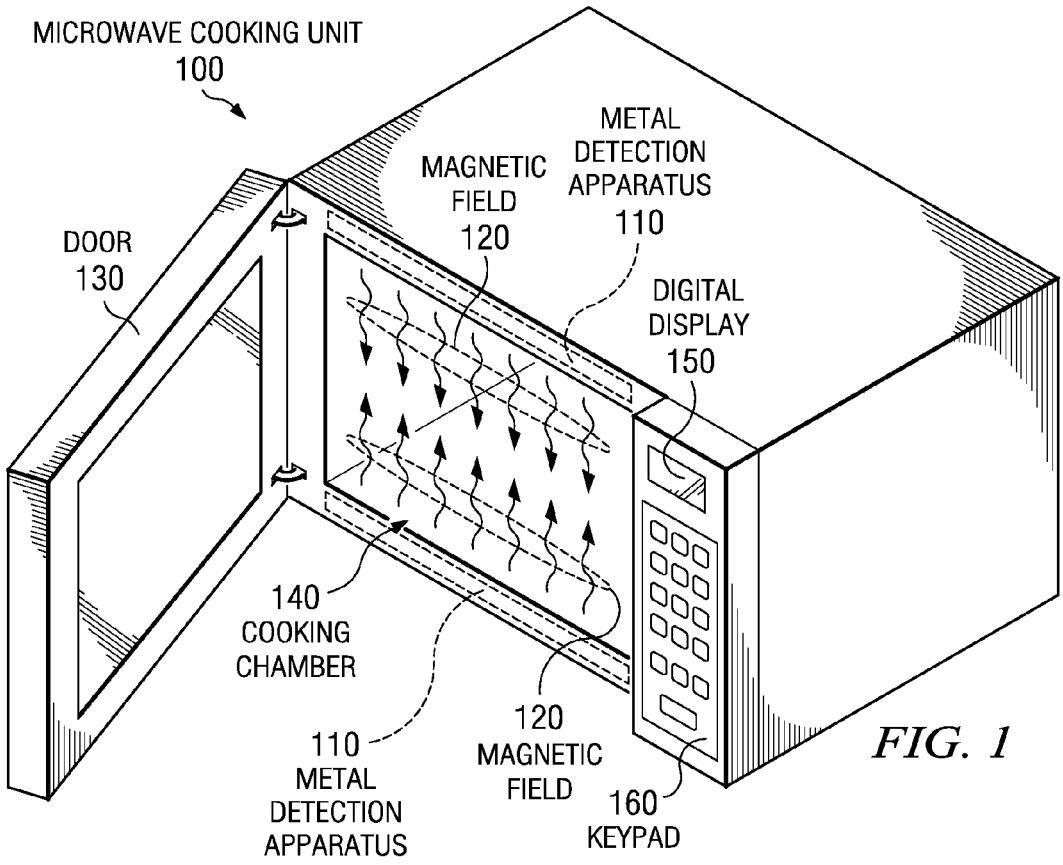
FIG. 1 is a block diagram of a microwave cooking unit in accordance with an illustrative embodiment.

With reference now to the figures and in particular with reference to FIG. 1, a pictorial representation of a microwave cooking unit in accordance with an illustrative embodiment. FIG. 1 is a block diagram of a microwave cooking unit in accordance with an illustrative embodiment. Microwave cooking unit 100 is a device utilizing microwaves for microwave cooking. As used herein, the term microwave cooking includes cooking, heating, melting, and/or defrosting a food item via microwave radiation. In this illustrative example, microwave cooking unit 100 is a microwave oven.

Microwave cooking unit 100 includes a metal detection apparatus 110. Metal detection apparatus 110 is any known or available device for detecting the presence of metal, including but not limited to, a very low frequency (VLF) or induction balance type metal detector, a pulse induction (PI) type metal detector, a beat-frequency oscillation (BFO) type metal detector, or any other known or available type of metal detection apparatus for detecting or sensing the presence of a metal object. In accordance with this illustrative embodiment, metal detection apparatus 110 comprises one or more metal detector(s) and a controller for controlling the operation of the metal detector(s).

Metal detection apparatus 110 generates a signal when it detects the presence of metal within a scan zone of metal detection apparatus 110. In this illustrative example, metal detection apparatus 110 is mounted in the face of microwave cooking unit 100. As used herein, the face of microwave cooking unit 100 includes any location associated with a front of microwave cooking unit 100. Thus, a face of microwave cooking unit 100 can include, but is not limited to, a frame or border of an opening to a cooking area of microwave cooking unit 100, a top, bottom, or side portion of a wall of cooking chamber at near the opening of the cooking chamber, a door frame, a front panel, and/or any other location of microwave cooking unit associated with a front or face portion of microwave cooking unit 100.

Metal detection apparatus 110 generates magnetic field 120 in the plane of door 130. The scan zone of metal detection apparatus 110 is the plane of door 130 occupied by magnetic field 120. Metal detection apparatus 110 is activated to generate magnetic field 120 when door 130 of microwave cooking unit is opened. When door 130 is closed, metal detection apparatus 110 is in a standby mode.

Cooking chamber 140 encloses a cooking area within microwave cooking unit 100. In this illustrative embodiment, cooking chamber is a shielded enclosure, such as a Faraday cage, that prevents microwave radiation from escaping into the environment outside the cooking area of microwave cooking unit 100. Door 130 is also layered with a conductive mesh type material that prevents microwave radiation from escaping into the environment outside the cooking area of microwave cooking unit 100.

When a user places a metal object into the cooking area, the metal object passes through the scan zone generated by magnetic field 120 as the metal object enters the microwave cooking area. Magnetic field 120 interacts with the metal object as it passes through the scan zone. In response to encountering magnetic field 120, the metal object generates a magnetic field of its own.

Metal detection apparatus 110 detects the magnetic field generated by the metal object as a user passes the metal object through the scan zone in the plane of door 130 when placing the metal object into the cooking area of microwave cooking unit 100. In response to detecting the metal object's magnetic field, metal detection apparatus 110 generates a signal indicating the presence of a metal object in microwave cooking unit.

Metal detection apparatus 110 also detects a metal object as a user removes the metal object from the cooking area. Metal detection apparatus 110 detects the metal object as the metal object passes through the magnetic field as the object is being pulled out of the cooking area. In this manner, metal detection apparatus 110 can detect the presence of a metal object as the object is placed inside the cooking area of microwave cooking unit 100. Metal detection apparatus can also detect the absence of the metal object by detecting the metal object as it is removed from the cooking area.

Digital display 150 and keypad 160 is a user interface that provides output to a user and accepts input from the user. Digital display 150 is any type of alphanumeric display for providing information to a user in the form of characters, numbers, symbols, or letters. Keypad 160 is an input device for data entry by a user. Keypad 160 comprises alphanumeric keys and functional keys. For example, keypad 160 can include, but is not limited to, numerical keys for numbers 1 though 9, a function key for microwave cooking popcorn, a function key for defrost setting, a function key to start microwave cooking, a function key to add 30 seconds to a cooking time, a function key for a timer setting, and/or a function key to pause and/or stop microwave cooking.

In accordance with an illustrative embodiment, metal detection apparatus 110 has a capability called discrimination. Discrimination permits metal detection apparatus 110 to determine and/or identify a type of metal entering the cooking area of microwave cooking unit 100. Discrimination is possible because every type of metal has a specific different response to stimulation by a magnetic field, such as magnetic field 120. For example, iron generates a stronger magnetic field in response to passing through magnetic field 120 than some other types of metal. Metal detection unit 110 with a discrimination capability identifies a type of metal based on the type of magnetic field generated by the metal object in response to passing through magnetic field 120 generated by metal detection unit 110.

Figure 2:
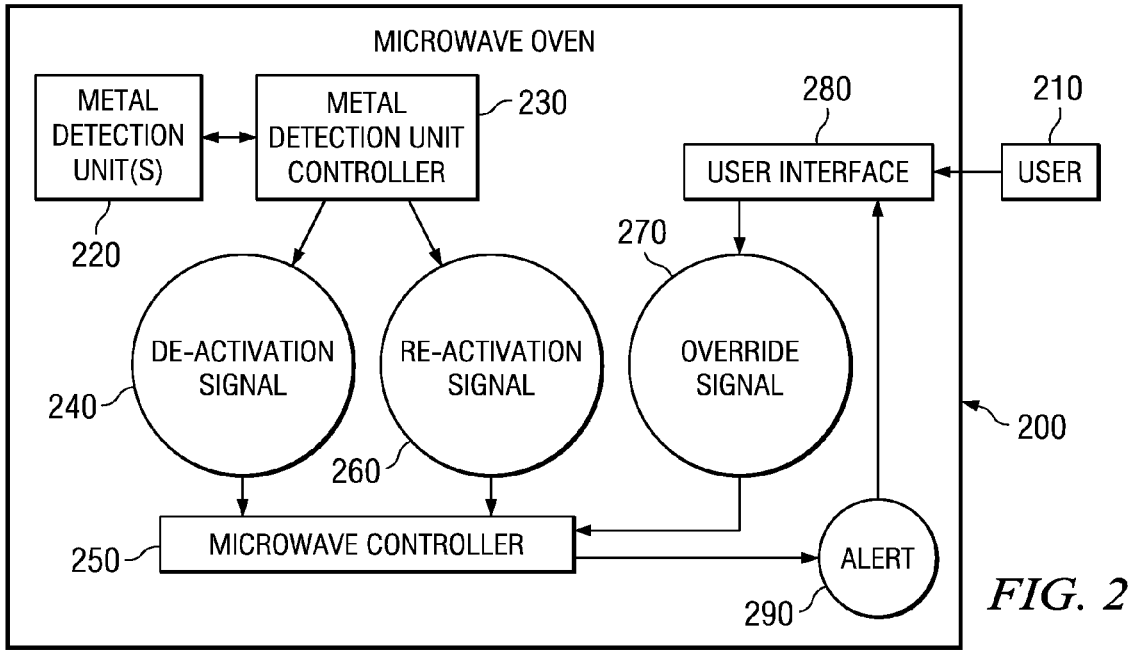
FIG. 2 is a block diagram illustrating data flow in a process for generating a notification of a presence of a metal object entering a cooking chamber in accordance with an illustrative embodiment.

FIG. 2 is a block diagram illustrating data flow in a process for generating a notification of a presence of a metal object entering a cooking chamber in accordance with an illustrative embodiment. Microwave oven 200 is a microwave cooking unit, such as microwave cooking unit 100 in FIG. 1.

When user 210 places a metal object, such as a metal plate or metal fork into microwave oven 200, metal detection unit(s) 220 detects the presence of the metal object. Metal detection unit(s) 220 is a metal detection apparatus, such as metal detection apparatus 110 of FIG. 1. Metal detection unit 220 is activated by metal detection unit controller 230 when user 210 opens the door of microwave oven 200. Metal detection unit controller 230 is any type of controller for controlling the operation of metal detection unit(s) 220. In this illustrative example, metal detection unit controller is an application for controlling the activation and de-activation of metal detection unit(s) 220.

Metal detection unit(s) 220 generates a magnetic field in the plane of the microwave oven door, as illustrated in FIG. 1.

When the metal object passes through the magnetic field, the metal object generates a magnetic field of its own. Metal detection unit controller 230 detects the magnetic field of the metal object. Metal detection unit controller 230 sends de activation signal 240 to microwave controller 250.

De-activation signal 240 is an indicator signal sent by metal detection unit controller 230 to indicate the presence of a metal object within microwave oven 200. In response to receiving de-activation signal 240, microwave controller 250 de-activates the microwave cooking feature of microwave oven 200. The microwave cooking feature is the feature that permits operation of microwave oven 200 for microwave cooking of one or more food items. If the microwave cooking feature is de-activated, the microwave oven will not function for the purposes of microwave cooking.

Microwave controller 250 is a controller for controlling the operation of microwave oven. In accordance with this illustrative example, microwave controller 250 controls microwave oven cooking feature by controlling the operation of a magnetron associated with microwave oven 200.

In this illustrative example, the magnetron of microwave oven 200 generates microwave radiation within the cooking area of microwave oven 200. Microwave controller 250 controls the intensity of microwave cooking by activating and deactivating the magnetron during microwave cooking. For example, when user 210 selects to cook a food item at half power for two minutes, microwave controller 250 activates and deactivates the magnetron at specific intervals during the two minute microwave cooking time to decrease the amount of microwave radiation generated by magnetron. The longer the interval duration and/or the more frequent the intervals during which the magnetron is de-activated, the less the intensity of the microwave cooking.

In response to receiving de-activation signal 240 from metal detection unit controller 230, microwave controller 250 de-activates the microwave cooking feature of microwave oven 200 by deactivating the magnetron. When user 210 attempts to start the microwave cooking feature, the microwave cooking feature will not operate. However, microwave controller 250 is not limited to controlling the microwave cooking feature by activating and de-activating the magnetron. In accordance with the aspects of the illustrative embodiments, microwave controller 250 controls the microwave cooking feature by any known method for controlling operation of a microwave cooking feature in microwave oven 200, including but not limited to controlling the magnetron, controlling the power supply to one or more parts of microwave oven, such as the magnetron, in addition to any other method for activating or deactivating a microwave cooking feature.

When user 210 removes the metal object from the microwave cooking area, metal detection unit(s) 220 detects the metal objecting passing through the scan zone at the doorway of the microwave cooking unit as the metal object is removed from the cooking area. In response, metal detection unit controller 230 sends re-activation signal 260 to microwave controller 250. Re-activation signal 260 is an indicator signal sent by metal detection unit controller 230 to indicate the absence of a metal object within microwave oven 200.

In an alternative embodiment, metal detection unit controller 230 indicates the absence or removal of a metal object from within microwave oven 200 by de-asserting de-activation signal 240. Microwave controller 250 de-activates the microwave cooking feature for as long as de-activation signal 240 is received. When de-activation signal 240 is no longer received, microwave controller reactivates the microwave cooking feature to permit operation of microwave oven for microwave cooking. In accordance with this embodiment, de-asserting de-activation signal 240 is an indicator of the absence or removal of the one or more metal objects from the microwave cooking area.

In response to receiving an indicator indicating the absence or removal of the one or more metal objects from the microwave cooking area, microwave controller 250 re-activates the microwave cooking feature. In accordance with this illustrative example, microwave controller 250 re-activates the microwave cooking feature by re-activating the magnetron associated with microwave oven 200.

In addition, user 210 can override the de-activation of the microwave cooking feature by entering an override signal, such as override signal 270. Override signal 270 may be any type of signal, password, alphanumeric sequence, phrase, symbol, letters, word, key, code, or any other predefined signal to override de-activation of a microwave cooking feature by microwave controller 250.

User 210 enters override signal 270 via user interface 280. In accordance with the aspects of the illustrative embodiments, a user can utilize any known or available user interface to enter an override signal. In this illustrative example, user interface 280 is a digital display and keypad, such as digital display 150 and keypad 160 in FIG. 1. User interface is implemented by means of software residing in computer readable media in operation within microwave oven 200.

In addition, microwave controller 250 displays alert 290 to user 210 via user interface 280. Alert 290 is any type of warning or notification of the presence of one or more metal objects in the cooking area of microwave oven 200. Alert 290 is presented to user 210 as any type of available alert or notification type, including, but not limited to a graphic alert, a sound alert, a vibration alert, a flashing visual alert, or any combination of these alert types. For example, upon receiving an indicator of the presence of one or more metal objects in the cooking area of microwave oven 200, microwave controller sends alert 290 to user interface 280 for presentation of alert 290 to user 210 by emitting a beeping sound in addition to a flashing LED display notifying user 210 to remove the one or more metal objects.

In accordance with another exemplary illustration of an embodiment, metal detection unit(s) 220 and metal detection unit controller 230 are embodied within a single component, rather than as two separate components as illustrated in FIG. 2.

In accordance with another illustrative embodiment, metal detection unit(s) 220 and/or metal detection unit controller 230 have a discrimination capability. A discrimination capability enables metal detection unit(s) 220 and/or metal detection unit controller 230 to identify a type of metal of a metal object that passes through a scan zone of metal detection unit(s) 220. Metal detection unit(s) 220 identifies the type of metal of a metal object based on the magnetic field generated by the metal object in response to passing through a magnetic field generated by metal detection unit(s) 220.

Metal detection unit determines whether to send de-activation signal 240 to microwave controller 250 based on whether the metal is a harmful metal. A harmful metal is a metal that could cause arcing, a fire, and/or any damage to microwave oven 200. For example, harmful metals could include tin foil, aluminum foil, and/or any other type of metal that could cause arcing, sparking, a fire hazard, and/or damage to microwave oven 200.

Metal detection unit(s) 220 and/or metal detection unit controller 230 ignores metal objects detected passing through a scan zone of metal detection unit(s) 220 if the metal object is a harmless metal object. A harmless metal object is a metal object determined to be a type of metal that does not cause arcing, sparking, a fire hazard, and/or damage to microwave oven 200.

As used herein, a set of harmful metals is a predefined or pre-selected set of harmful metals. A set of harmful metals includes one or more of a type of metal that is a harmful metal. As used herein, a set of harmless metals is a predefined or pre-selected set of harmless metals. In accordance with another example, the set of harmful metals is a user-defined or user-modified set of harmful metals. In accordance with another example, the category of harmful metals is a user-defined or user-modified set of harmful metals.

In this illustrative example, metal detection unit 230 is activated to scan for a presence of a metal object placed into microwave oven 200. As used herein, the term "placed into" includes a metal object entering a microwave oven as it is being placed into the microwave cooking area, as well as a metal object that is already placed inside the cooking area of the microwave oven. In this illustrative example, metal detection unit 230 is activated to scan for a presence of a metal object when a user opens the door of microwave oven 200. In accordance with another illustrative example, metal detection unit 230 is activated to scan for a presence of a metal object when user 210 selects a control to activate the metal detection unit, selects a control to begin microwave cooking, and/or closes a door of the microwave oven.

In accordance with this illustrative embodiment, metal detection unit 230 detects the presence of one or more metal objects as the metal objects are entering the cooking area of microwave oven 200. A metal object enters the cooking area as the metal objects crosses a plane of the door of the microwave oven 200. However, in accordance with another illustrative example, a metal object is detected after the metal object enters the microwave cooking area. For example, metal detection unit 230 detects the presence of one or more metal objects placed into the cooking area when a user activates a cooking feature. Thus, in accordance with the illustrative embodiments, metal detection unit 230 can detect the presence of a metal object as the object is entering the microwave oven cooking area, after the metal object is placed inside the cooking area but before user 210 selects to activate the microwave cooking feature to start microwave cooking, when a metal object is removed from a microwave cooking area, and/or any other time during which a metal object is within a scan zone of a metal detection unit associated with microwave oven 200.

Metal detection unit controller 230 identifies the type of metal of the metal object based on the magnetic field generated by the metal object. If metal detection unit controller determines that the type of metal is a harmful metal, metal detection unit controller 230 sends de-activation signal 240 to microwave controller 250. If metal detection unit controller 230 determines that the type of metal of the metal object is a harmless metal, metal detection unit controller 230 does not send de-activation signal 240. In other words, metal detection unit controller 230 ignores the metal object if the type of metal of metal object is not a harmful metal.

In accordance with another illustrative embodiment, microwave controller 250 provides an identification of the type of metal detected by metal detection unit(s) 220 to user 210 via user interface 280. User 210 can override alert 230 and/or deactivation of the microwave cooking feature of microwave oven 200 based on the type of metal of the metal object.

Figure 3:
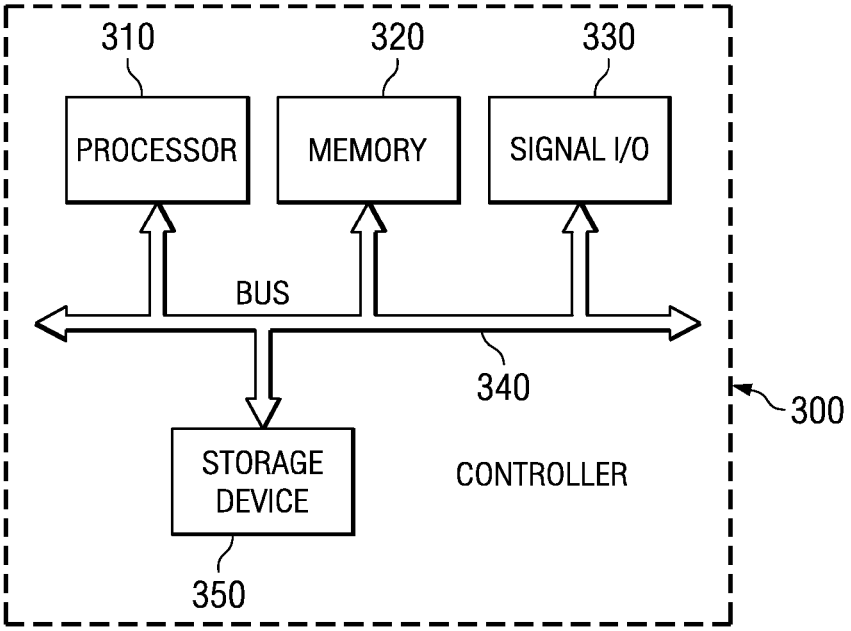
FIG. 3 is a block diagram of a controller in accordance with an illustrative embodiment.

FIG. 3 is a block diagram of a controller in accordance with an illustrative embodiment. Controller 300 is an example of a controller such as metal detection unit controller 230 and/or microwave oven controller 250 in FIG. 2, in which code or instructions implementing the processes of the illustrative embodiments may be located. In the depicted example, processor 310, memory 320, and signal input/output (I/O) 330 are connected via bus 340. Bus 340 may be comprised of one or more buses, such as a system bus and/or an I/O bus. Bus 340 may be implemented using any type of communications fabric or architecture that provides for a transfer of data between different components or devices attached to the fabric or architecture. Processor 310 may include one or more processors or CPUs. Memory 320 may be a main memory or a cache. Signal input/output 330 includes one or more devices for sending and receiving signals to and from different components in a microwave cooking unit, such as digital display 150 and keypad 160 in FIG. 1.

Storage device 350 is also optionally connected to bus 340. Storage device 350 may include any type of permanent and removable storage media. Program code and instructions are located on storage device 350 and may be loaded into memory 320 for execution by processor 310. The processes of the illustrative embodiments are preformed by processor 310 using computer implemented instructions, which may be located in memory 320. Processor 310, memory 320, signal input/output 330, and storage device 350 are functional components that can be implemented as functions in an application specific integrated circuit rather than using a processor paradigm. Those of ordinary skill in the art will appreciate that the hardware of FIGS. 1-3 may vary depending on the implementation.

A controller, such as metal detection unit controller 230 and/or microwave oven controller 250 in FIG. 2, issues an alert to a user via a user interface in response to receiving an indicator of the presence of the metal object(s) from one or more metal detectors associated with the microwave cooking unit. An alert can take the form of any type of indicator of the presence of one or more metal objects in a cooking area of a microwave cooking unit, such as a visual or auditory alert. The controller discontinues the alert when the controller receives an override signal. A metal detector sends an override signal to the controller if the metal detector detects the removal of the metal object from the cooking area as the metal object passes through a scan zone in the opening of the microwave cooking unit. In addition, a user interface sends an override to the metal detection unit controller in response to a user entering an override code or activating an override feature to discontinue the alert. A user activates an override feature to discontinue the alert where a user chooses to operate the microwave cooking feature of a microwave cooking unit regardless of the metal detector's detection of metal object(s). A user may choose to activate an override where a metal object detected by the metal detector is safe for microwave use. In accordance with another illustrative embodiment, an alert indicator of the presence of metal object(s) detected entering a microwave cooking area is sent to a user via a user interface until an override is received.

In accordance with another illustrative embodiment, the indicator is sent for a predetermined period of time. At the expiration of the predetermined period of time, the alert indicator is discontinued. In this illustrative example, if a microwave cooking feature is disabled when metal object(s) are detected, the microwave cooking feature is re-enabled after the expiration of the predetermined period of time.

Figure 4:
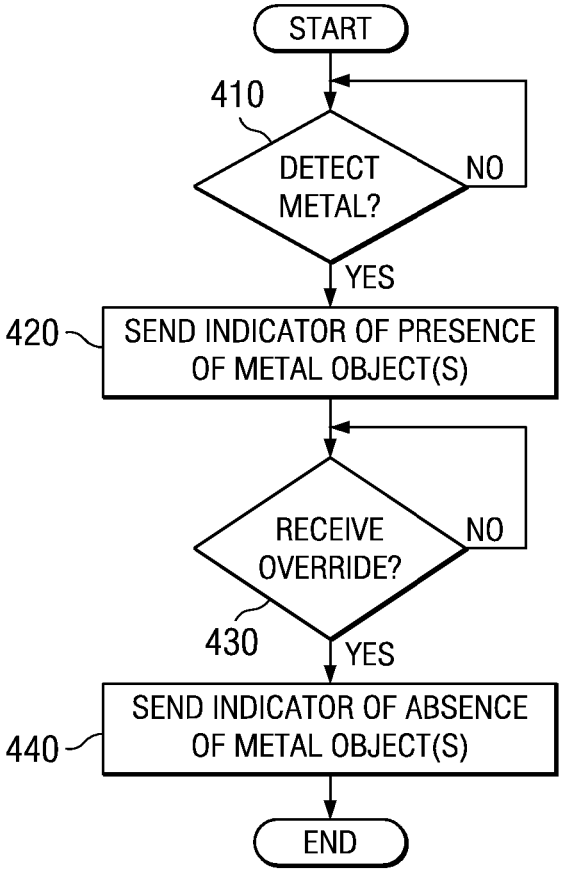
FIG. 4 is a flowchart illustrating a process for sending an indicator of the presence and/or absence of a metal object in accordance with an illustrative embodiment.

FIG. 4 is a flowchart illustrating a process for sending an indicator of the presence and/or absence of a metal object in accordance with an illustrative embodiment. The process is implemented by an application for controlling one or more metal detection units, such as metal detection unit controller 230 in FIG. 2.

The process begins by determining if one or more metal objects are detected within the scan zone of one or more metal detectors associated with a microwave cooking unit (step 410). If no metal objects are detected, the process returns to step 410 until one or more metal objects are detected. When one or more metal objects are detected, the process sends an indicator of the presence of one or more metal objects in a cooking area of the microwave cooking unit (step 420) to a microwave controller. In accordance with the aspects of the illustrative embodiments, an indicator of the presence of the one or more metal objects in the microwave cooking area includes, but is not limited to, a de-activation signal, de-asserting a re-activation signal, or any other type of signal for indicating the presence of the one or more metal objects from the microwave cooking area.

Next, the process determines if an override has been received (step 430). If an override has not been received, the process returns to step 420 until a determination is made that an override has been received.

In response to determining that an override has been received, the process sends an indicator of the absence or removal of the one or more metal objects from the microwave cooking area (step 440) to the controller, with the process terminating thereafter. In accordance with the aspects of the illustrative embodiments, an indicator of the absence or removal of the one or more metal objects from the microwave cooking area includes, but is not limited to, a re-activation signal, a de-asserting of the de-activation signal, or any other type of signal for indicating the absence or removal of the one or more metal objects from the microwave cooking area.

Figure 5:
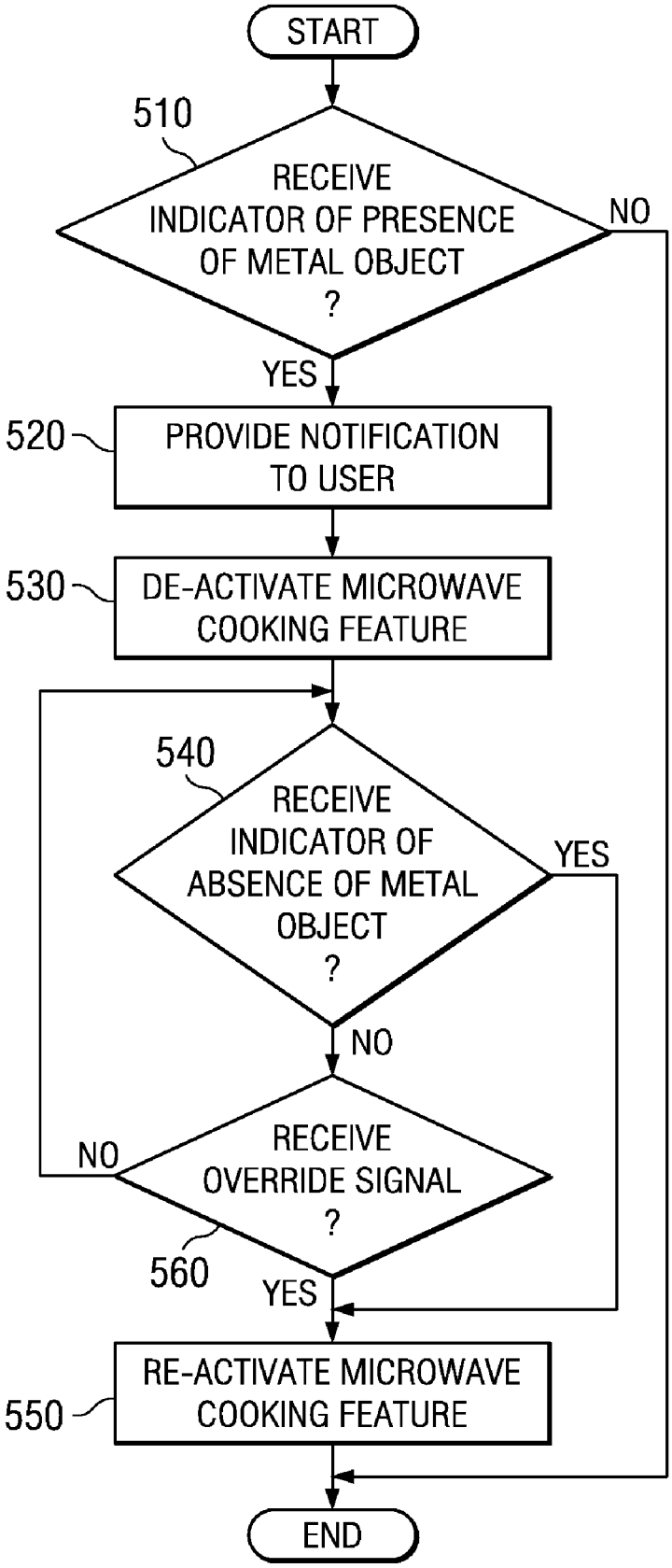
FIG. 5 is a flowchart illustrating a process for providing notification of the presence of a metal object passing into and/or out of a cooking chamber of a microwave cooking unit in accordance with an illustrative embodiment.

FIG. 5 is a flowchart illustrating a process for providing notification of the presence of a metal object passing into and/or out of a cooking chamber of a microwave cooking unit in accordance with an illustrative embodiment. The process is implemented by a software application for controlling a microwave cooking unit, such as microwave controller 250 in FIG. 2.

The process begins by receiving an indicator of the presence of one or more metal objects in a microwave cooking area (step 510). The process provides an alert or notification to the user (step 520) via a display or user interface. The process then de-activates the microwave cooking feature of the microwave oven (step 530) rendering the microwave oven incapable of operating for the purposes of microwave cooking until the microwave cooking feature is re-activated.

The process determines if an indicator of the absence or removal of the one or more metal objects is received (step 540). If a determination is made that the indicator of the absence or removal of the one or more metal objects is received, the process re-activates the microwave cooking feature (step 550) with the process terminating thereafter.

Returning now to step 540, if a determination is made that the indicator of the absence or removal of the one or more metal objects is not received, the process determines if an override signal is received (step 560) from the user. If an override signal is not received, the process returns to step 540 until either an indicator of the removal of the one or more metal objects is received or an override signal is received.

Returning now to step 560, if a determination is made that an override signal is received, the process re-activates the microwave cooking feature (step 550) enabling the user to start microwave cooking, with the process terminating thereafter.

Thus, the illustrative embodiments are directed to a method, computer usable program code, and an apparatus for dynamically detecting metal in a microwave cooking unit and providing a warning to a user of the microwave cooking unit. A metal object inside a cooking area of a microwave cooking unit can cause sparks, fires, explosions, and/or damage to the magnetron. Damage to the magnetron can render a microwave cooking unit incapable of producing microwaves for cooking or heating food. The illustrative embodiments provide a metal detection unit in association with a microwave cooking unit to detect the presence and/or absence of metal objects within a cooking area of the microwave cooking unit. A warning or notification is provided to a user if metal is detected. Thus, the aspects of the illustrative embodiments provide a protection mechanism to prevent damage to a microwave cooking unit due to the presence of one or more metal objects in a cooking area of the microwave cooking unit.

The flowchart and block diagrams in the figures illustrate the architecture, functionality, and operation of some possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The invention can take the form of an entirely hardware embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A computer implemented method in a data processing system, for detecting metal objects placed in a microwave cooking unit, the computer implemented method comprising:

activating a metal detection unit to scan for a presence of a metal object placed into a cooking area associated with the microwave cooking unit wherein the metal detection unit is activated to scan for a presence of a metal object entering the cooking area of the microwave cooking unit;

scanning a plane of an opening to the cooking area for the presence of the metal object; and responsive to receiving an indicator of the presence of a metal object from the metal detection unit, generating an alert indicating the presence of the metal object.

2. The computer implemented method of claim 1 further comprising:

identifying a type of metal associated with the metal object.

3. The computer implemented method of claim 2 wherein the alert indicating the presence of the metal object is sent if the type of metal associated with the metal object is a harmful metal.

4. The computer implemented method of claim 1 further comprising:

de-activating a microwave cooking function of the microwave cooking unit responsive to detecting a presence of a metal object.

5. The computer implemented method of claim 4 further comprising:

re-activating the microwave cooking function upon receiving an indicator of the removal of the metal object from the cooking area.

6. The computer implemented method of claim 4 further comprising:

re-activating the microwave cooking function of the microwave cooking unit upon receiving an override signal.

7. The computer implemented method of claim 1, wherein the metal detection unit is located in a face of the microwave cooking unit and wherein the activating step further comprises:

detecting, by the metal detection unit, any metal object that passes through a scan zone at the opening of the microwave cooking unit.

8. The computer implemented method of claim 1, wherein the activating step further comprises:

triggering activation of the metal detection unit, wherein activation is triggered by opening a door of the microwave cooking device.

9. A computer implemented method, in a data processing system, for detecting metal objects placed in a microwave cooking unit, the computer implemented method comprising:

generating a first magnetic field in a scan zone of a metal object detector associated with the microwave cooking unit;

detecting a magnetic field associated with the metal object in the scan zone;

identifying a metal type of the metal object based on the magnetic field generated by the metal object, wherein the metal type is one of a harmful metal type and a harmless metal type;

responsive to determining that the metal type is the harmful metal type, sending an indicator of the presence of the metal object to a microwave controller; and responsive to receiving the indicator of the presence of the metal object by the microwave controller, deactivating the microwave cooking feature of the microwave oven, wherein deactivating renders the microwave oven incapable of operating.

10. The computer implemented method of claim 9 further comprising:

providing an alert indicator of the presence of the metal object in the cooking area, using a display coupled to the microwave cooking unit.

11. The computer implemented method of claim 9 further comprising:

responsive to determining an override has been received, sending an indicator of the absence of the metal object from the cooking area, reactivating the microwave cooking feature of the microwave oven.

12. The computer implemented method of claim 9 further comprising:

responsive to sending the indicator of the absence of the metal object from the cooking area, reactivating the microwave cooking feature of the microwave oven.

* * * * *